US011230405B2

(12) United States Patent
Fahlke

(10) Patent No.: US 11,230,405 B2
(45) Date of Patent: Jan. 25, 2022

(54) CHILD-RESISTANT LOCKING MECHANISM FOR CONTAINER

(71) Applicant: C3R Investments Ltd., Richmond (CA)

(72) Inventor: Christopher George Fahlke, Surrey (CA)

(73) Assignee: C3R Investments Ltd., Richmond (CA)

( * ) Notice: Subject to any disclaimer, the term of this patent is extended or adjusted under 35 U.S.C. 154(b) by 111 days.

(21) Appl. No.: 16/528,010

(22) Filed: Jul. 31, 2019

(65) Prior Publication Data

US 2021/0031969 A1 Feb. 4, 2021

(51) Int. Cl.
*B65D 5/38* (2006.01)
*B65D 50/04* (2006.01)

(52) U.S. Cl.
CPC ..... *B65D 5/38* (2013.01); *B65D 50/046* (2013.01)

(58) Field of Classification Search
CPC .... B65D 5/38; B65D 50/046; B65D 2215/00; B65D 2215/02; B65D 2215/04
USPC ..... 206/1.5, 528
See application file for complete search history.

(56) References Cited

U.S. PATENT DOCUMENTS 4,076,117 A 2/1978 Wisdom et al.
4,364,488 A 12/1982 Anjou
5,011,010 A 4/1991 Francis et al.
5,379,570 A 1/1995 Terjung et al.
5,527,090 A 6/1996 Cone
5,588,276 A 12/1996 Terjung et al.
2003/0029676 A1 2/2003 Gibson et al.
2005/0183981 A1 8/2005 Gelardi
2008/0308615 A1* 12/2008 Kong ..... B65D 5/503 229/117.12
2009/0050659 A1 2/2009 Chou et al.
2009/0081336 A1 3/2009 Tuszkiewicz et al.
2012/0234701 A1 9/2012 Albrecht et al.
2015/0307246 A1* 10/2015 Patwardhan ..... B65D 55/02 206/1.5
2016/0251107 A1* 9/2016 Everett ..... B65D 5/38 206/1.5
2017/0036808 A1* 2/2017 Everett ..... B65D 5/541

FOREIGN PATENT DOCUMENTS

CA 3051685 A1 1/2021

OTHER PUBLICATIONS

Written Opinion 0135772A1 dated May 25, 2001.
CA3051685A1 Office Action dated Oct. 2, 2020.

* cited by examiner

*Primary Examiner* — Steven A. Reynolds
*Assistant Examiner* — Javier A Pagan
(74) *Attorney, Agent, or Firm* — Rowan TELS LLC

(57) ABSTRACT

A container and method of use are disclosed that provide secure storage. This storage prevents stored items from being accessed by children, for example. This secure storage may be provided by a container manufactured from a single sheet of cut cardboard or similar material. No additional components are needed to provide the locking mechanism, which is constructed completely from folds in the cardboard.

20 Claims, 11 Drawing Sheets

CHILD-RESISTANT LOCKING MECHANISM FOR CONTAINER

BACKGROUND

As a wide range of drugs are legalized for medicinal and recreational use, new forms of childproof packaging are needed. Some adult users may need packaging that is easier to open than conventional childproof containers, but that still prevents access to the contents by young children. As a number of regions that have legalized these products are also exploring legislation to reduce consumer plastics in their areas, a childproof container that can be manufactured easily and inexpensively from completely recyclable or biodegradable materials is desired.

BRIEF SUMMARY

A container is disclosed comprising a sleeve and a tray. The sleeve comprises a sleeve top member, a sleeve bottom member in a spaced apart, substantially parallel arrangement with the sleeve top member, a sleeve first side member adjoining the sleeve top member and sleeve bottom member, and a sleeve second side member opposite the sleeve first side member and adjoining the sleeve top member and sleeve bottom member. Thus an aperture is formed by these members in a first sleeve end and a second sleeve end.

The sleeve further comprises a sleeve retaining flap included on at least one of the sleeve first side member, sleeve second side member, and sleeve bottom member. The sleeve also comprises a sleeve lock release tab on at least one of the sleeve first side member, sleeve second side member, and sleeve bottom member, in proximity to the sleeve retaining flap.

The tray included in the disclosed container is configured to slide into the aperture of the sleeve in at least one of the first sleeve end and the second sleeve end. The tray includes a tray bottom member, a tray first side member adjoined to and substantially perpendicular to the tray bottom member, and a tray second side member adjoined to and substantially perpendicular to the tray bottom member and opposite the tray first side member.

The tray further comprises a tray spring assembly and a tray locking tab configured to be engaged by the sleeve lock release tab. At least one of the tray first side member, the tray second side member, and the tray bottom member include the tray spring assembly and the tray locking tab. The tray locking tab is configured to engage the sleeve retaining flap on condition that the tray spring assembly is in an uncompressed state and the tray is forced in a direction to slide the tray out of the aperture, thereby retaining the tray in the sleeve. The tray locking tab is configured to not engage the sleeve retaining flap on condition that the tray spring assembly is in a compressed state and the tray is forced in a direction to slide the tray out of the aperture, thereby allowing the tray to slide out of the sleeve.

A method is disclosed herein for securing an item in the disclosed container. The method comprises placing the item into a tray of the container, wherein the tray is slidable into a sleeve of the container. The method further comprises sliding the tray into an aperture of the sleeve until a tray locking tab is in a position that is engageable by a sleeve lock release tab. The method further comprises compressing a tray spring assembly and sliding the tray at least partially out of the aperture.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
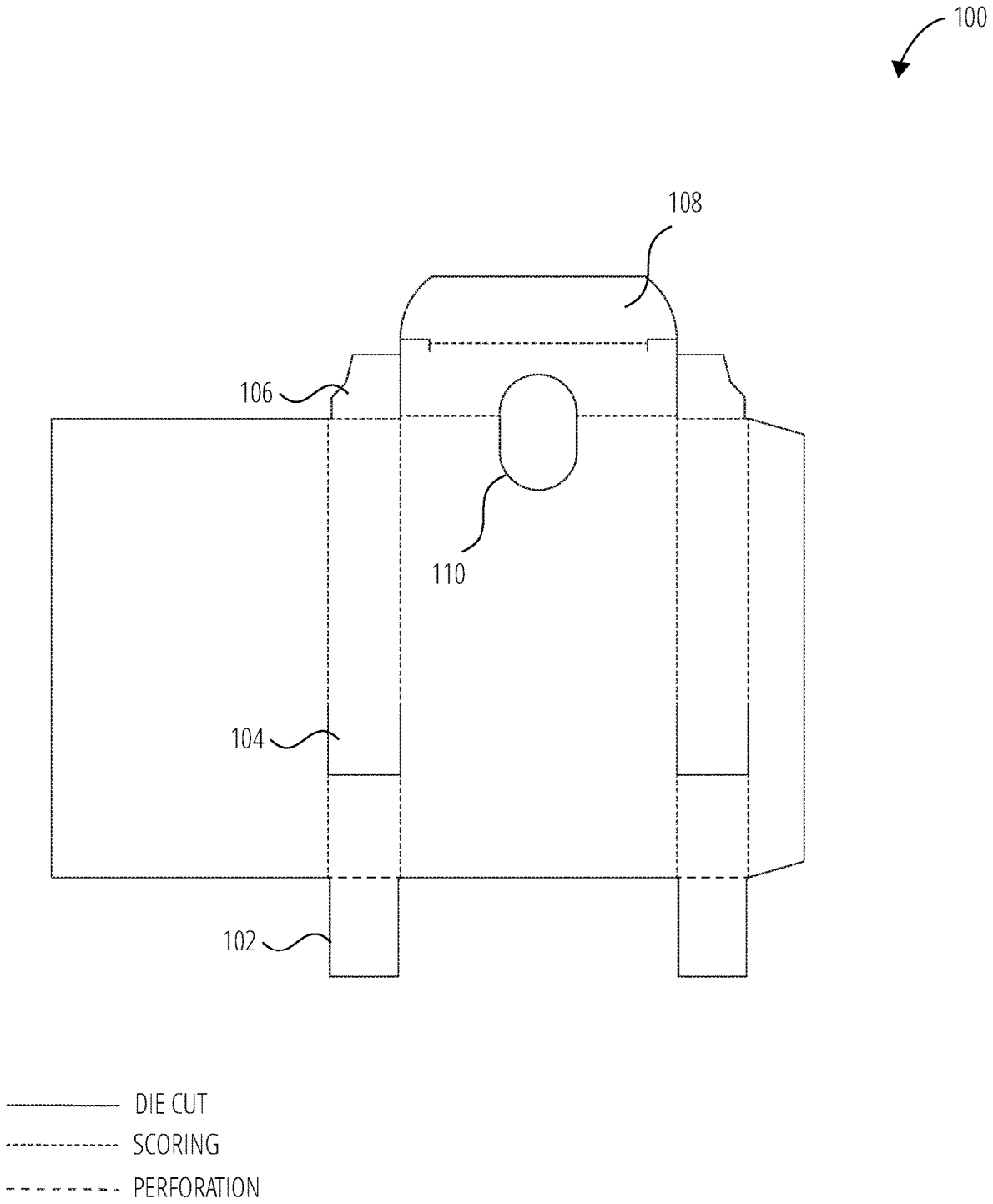
FIG. 1 illustrates a container sleeve flat 100 in accordance with one embodiment.

A container and method for use are disclosed herein which may allow secure or childproof storage of items and may be manufactured from a single sheet of cardboard or other adequately sturdy material, with no additional components or materials needed. This allows companies such as drug manufacturers to safely and inexpensively package their product in a container that is completely recyclable or biodegradable.

A container is disclosed comprising a sleeve and a tray. The sleeve comprises a sleeve top member, a sleeve bottom member in a spaced apart, substantially parallel arrangement with the sleeve top member, a sleeve first side member adjoining the sleeve top member and sleeve bottom member, and a sleeve second side member opposite the sleeve first side member and adjoining the sleeve top member and sleeve bottom member. Thus, an aperture is formed by these members in a first sleeve end and a second sleeve end.

The sleeve further comprises a sleeve retaining flap included on at least one of the sleeve first side member, sleeve second side member, and sleeve bottom member. The sleeve also comprises a sleeve lock release tab on at least one of the sleeve first side member, sleeve second side member, and sleeve bottom member, in proximity to the sleeve retaining flap.

The tray included in the disclosed container is configured to slide into the aperture of the sleeve in at least one of the first sleeve end and the second sleeve end. The tray includes a tray bottom member, a tray first side member adjoined to and substantially perpendicular to the tray bottom member, and a tray second side member adjoined to and substantially perpendicular to the tray bottom member and opposite the tray first side member.

The tray further comprises a tray spring assembly and a tray locking tab configured to be engaged by the sleeve lock release tab. At least one of the tray first side member, the tray second side member, and the tray bottom member include the tray spring assembly and the tray locking tab. The tray locking tab is configured to engage the sleeve retaining flap on condition that the tray spring assembly is in an uncompressed state and the tray is forced in a direction to slide the tray out of the aperture, thereby retaining the tray in the sleeve. The tray locking tab is configured to not engage the sleeve retaining flap on condition that the tray spring assembly is in a compressed state and the tray is forced in a direction to slide the tray out of the aperture, thereby allowing the tray to slide out of the sleeve.

A method is disclosed herein for securing an item in the disclosed container. The method comprises placing the item into a tray of the container, wherein the tray is slidable into a sleeve of the container. The method further comprises sliding the tray into an aperture of the sleeve until a tray locking tab is in a position that is engageable by a sleeve lock release tab. The method further comprises compressing a tray spring assembly and sliding the tray at least partially out of the aperture.

Figure 5:
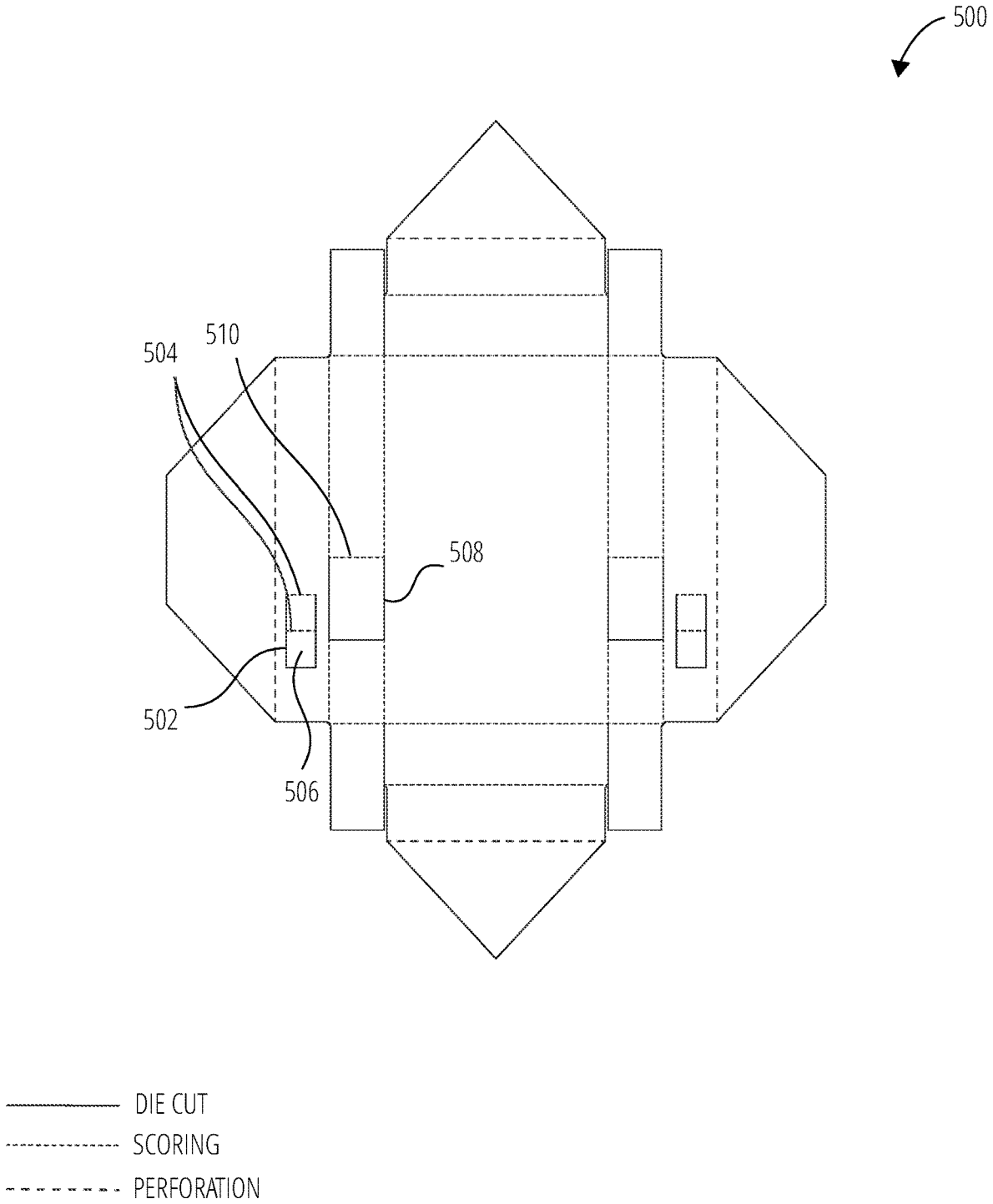
FIG. 5 illustrates a container tray flat 500 in accordance with one embodiment.

A single sheet of cardboard, card stock, or other suitable material may be die cut or otherwise divided into the two flats illustrated in FIG. 1 and FIG. 5. These figures illustrate cut, scored, and perforated flat cardboard panels that may be folded into a sleeve and a tray, respectively. The tray may be fit inside the sleeve in a manner that engages a locking mechanism that prevents the tray from being removed from the sleeve unless appropriate steps are taken, as described in FIG. 11.

The locking mechanism disclosed herein comprises a set of opposing tabs on both the sleeve and the tray that may engage each other when the tray begins to slide out of the sleeve. These tabs are compelled to engage through the action of a folded spring that is formed from a cutout in the tray flat. An additional flap on the sides of the sleeves allows the user to apply a compressive force to the sides of the sleeve that is then transferred to the tray, compressing the spring and allowing the opposing tabs to disengage. With the tabs disengaged, the tray may be slid out of the sleeve.

An embodiment for this secure container is illustrated in the figures that follow. This embodiment, as stated, is configured with two sleeve retaining flaps on either side of the sleeve and two tray locking tabs on either side of the tray. In the illustrated embodiment, both flap and tab pairs prevent the motion of the tray in a single direction. The tray is prevented from sliding from the opposing end of the sleeve by virtue of the fact that only one end of the sleeve has an opening wide enough to allow passage of the tray.

One of skill in the art will recognize that this is only one embodiment, and that the container and method disclosed herein may be embodied in other ways. For example, both ends of the sleeve may be open, and two sets of flaps and tabs may be provided, preventing motion in either direction until at least one set is disengaged. Alternately, a single set may be provided, but the flap and tab pairs may be oriented in opposite directions to prevent motion until at least one pair is disengaged. A sleeve with a closed end may be implemented that uses only one flap and tab pair to prevent the tray from exiting the single aperture. A number of embodiments are possible in addition to that illustrated below.

FIG. 1 illustrates a container sleeve flat 100 in accordance with one embodiment. The flat may be cut out of a sheet of cardboard or similar material using a die or stamp type cutter or other cutting implement. Solid lines show where a die may cut through the cardboard. Dotted lines show where the cardboard may be scored to facilitate folding during assembly without perforating through the cardboard. Dashed lines show where the cardboard may be perforated for more acute folding angles.

Cutting, scoring, and perforation may be used to introduce a number of features into the flat configuration. These features may include a sleeve retaining flap 102, intended to engage with a tray locking tab, a sleeve lock release tab 104, intended to allow a user to induce a deflecting force to disengage the sleeve from the tray, a sleeve end tabs 106, intended to facilitate a closed end member on one end of the sleeve, a sleeve end flap 108, intended to form the closed end member, and a pushing aperture 110, intended to allow the user to exert a pushing force upon the otherwise enclosed tray in order to begin sliding the tray out of the sleeve.

Figure 2A:
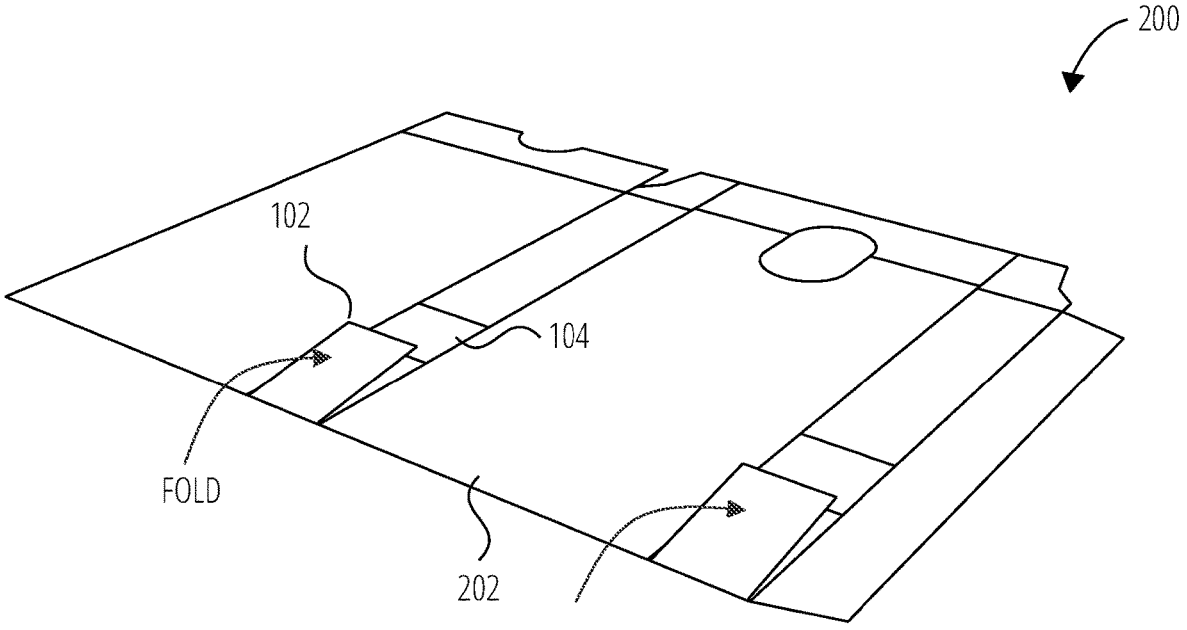
FIGS. 2A and 2B illustrate a container sleeve fold assembly 200 in accordance with one embodiment.
Figure 2B:
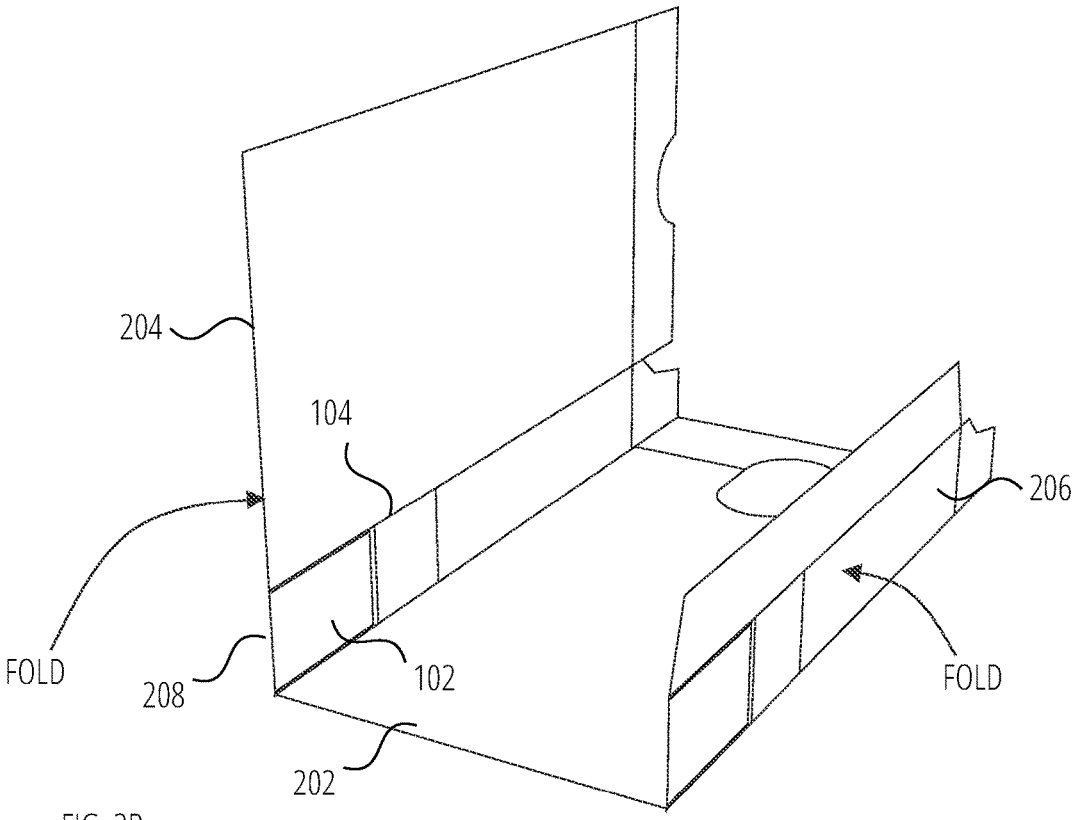

FIGS. 2A and 2B illustrate initial steps in the container sleeve fold assembly 200 in accordance with one embodiment. The sleeve retaining flap 102 on both sides of the sleeve bottom member 202 may be folded up against the rest of the flat, such that they form tabs that will open inward within the aperture of the assembled sleeve.

Next, the sleeve first side member 206 may be folded up to form a right angle with the sleeve bottom member 202. The sections of cardboard forming sleeve second side member 208 and sleeve top member 204 may also be folded up to form a right angle with the sleeve bottom member 202.

Figure 3A:
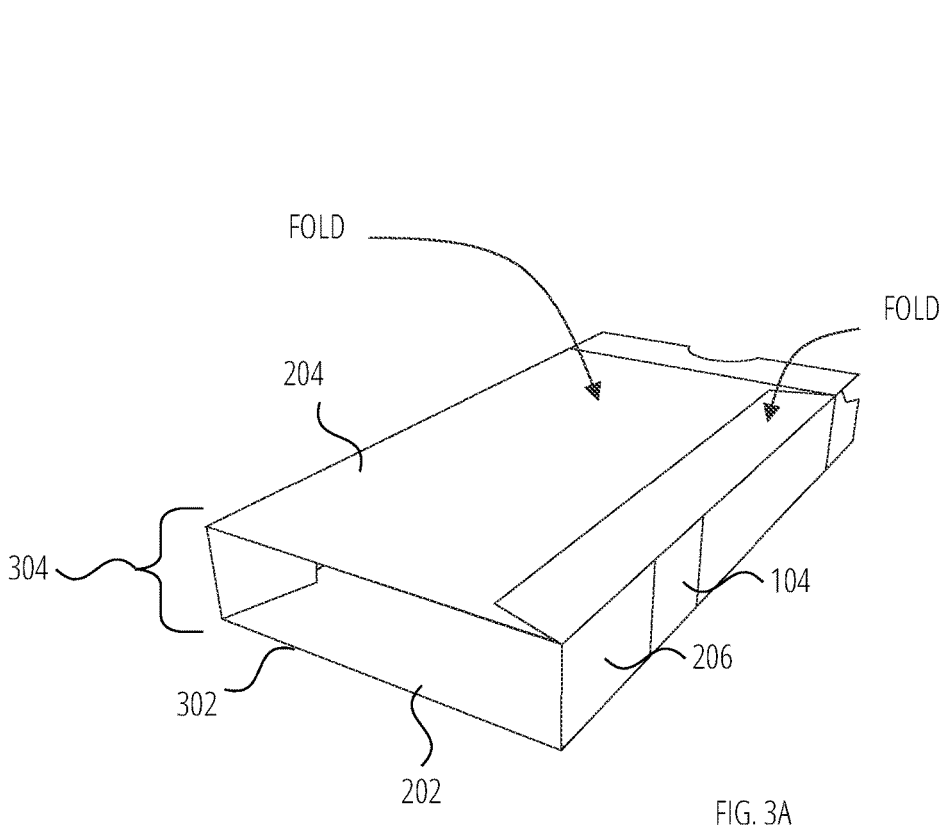
FIGS. 3A and 3B illustrate a container sleeve fold assembly 300 in accordance with one embodiment.
Figure 3B:
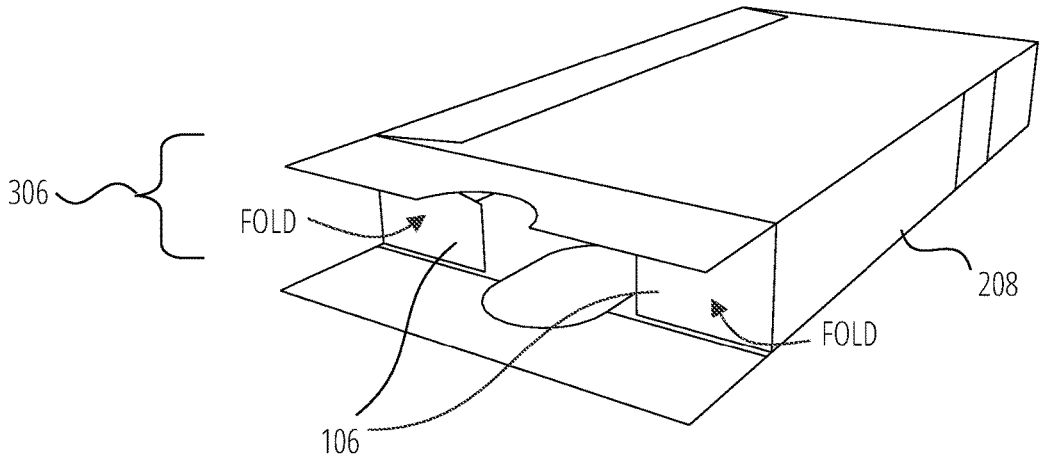

FIGS. 3A and 3B illustrate next steps in the container sleeve fold assembly 300 in accordance with one embodiment. The sleeve top member 204 and the retaining flap next to the sleeve first side member 206 may be folded over. These flaps may be affixed to each other to complete four sides of the sleeve. These four sides in this configuration form an aperture 302 through which the tray may be inserted and removed from the sleeve.

In this stage of assembly, the four sides of the sleeve may also form a first sleeve end 304 and a second sleeve end 306. In one embodiment, the first sleeve end 304 may comprise the aperture 302 through which the tray may be inserted and removed. The sleeve end tabs 106 may be folded inward to begin closing off the second sleeve end 306. The second sleeve end 306 may require further assembly as shown in FIGS. 4A and 4B.

Figure 4A:
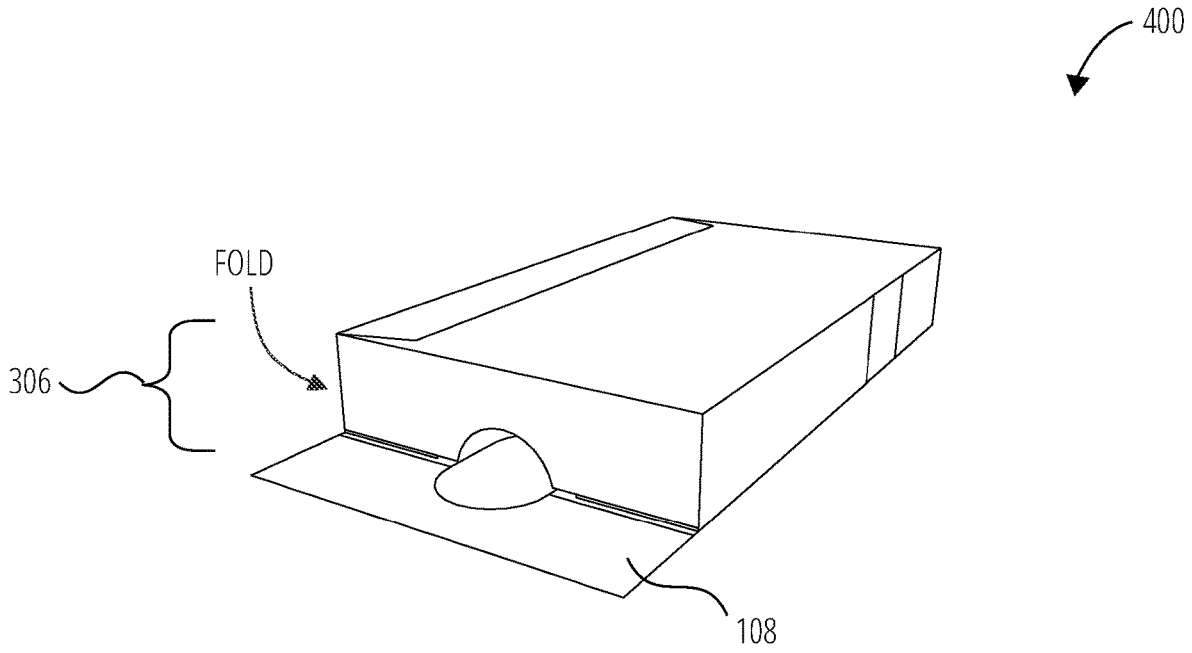
FIGS. 4A and 4B illustrate a container sleeve fold assembly 400 in accordance with one embodiment.
Figure 4B:
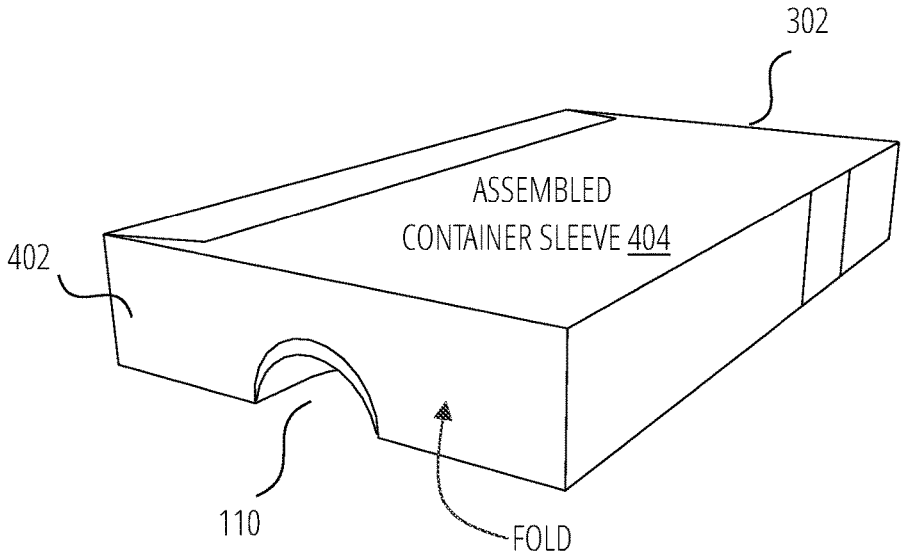

FIGS. 4A and 4B illustrate the final steps in the container sleeve fold assembly 400 in accordance with one embodiment. One sleeve end flap 108 or two sleeve end flaps, depending on the embodiment, may be folded over to close off second sleeve end 306 and form the end member 402. The end member 402 may be located directly across the sleeve from the aperture 302.

In this manner, a container sleeve 404 may be assembled from the container sleeve flat 100. The container sleeve 404 may be almost completely enclosed, with the aperture 302 kept open for the insertion of the tray, and with a pushing aperture 110 in the second sleeve end 306 kept open in order to exert force on the tray when removing it from the sleeve.

In the illustrated embodiment, a sleeve end flap 108 adjacent to the pushing aperture 110 may be folded over and affixed (e.g., with an adhesive such as glue or tape) to the outside of a flap that is notched so as not to occlude the pushing aperture. In an alternate embodiment, the sleeve end flap 108 adjacent to the pushing aperture 110 may be folded first and affixed to the inside of the notched end flap. Other end member 402 configurations may also be employed to close off the end opposite the aperture 302 but allow a user to exert a force on the container tray within the container sleeve 404.

FIGS. 5A and 5B illustrate a container tray flat 500 in accordance with one embodiment. The flat may be cut out of a sheet of cardboard or similar material using a die or stamp type cutter or other cutting implement. Solid lines show where a die may cut through the cardboard. Dotted lines show where the cardboard may be scored to facilitate folding during assembly without perforating through the cardboard. Dashed lines show where the cardboard may be perforated for more acute folding angles.

Figure 7A:
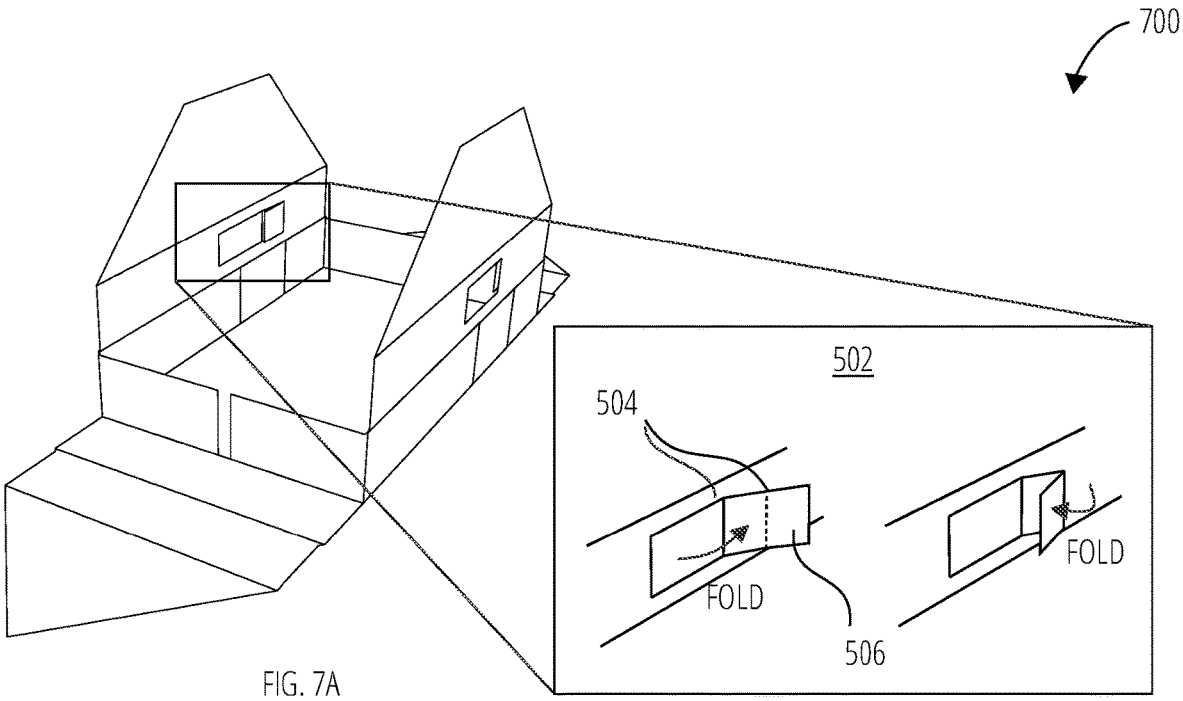
FIGS. 7A and 7B illustrate a container tray fold assembly 700 in accordance with one embodiment.
Figure 7B:
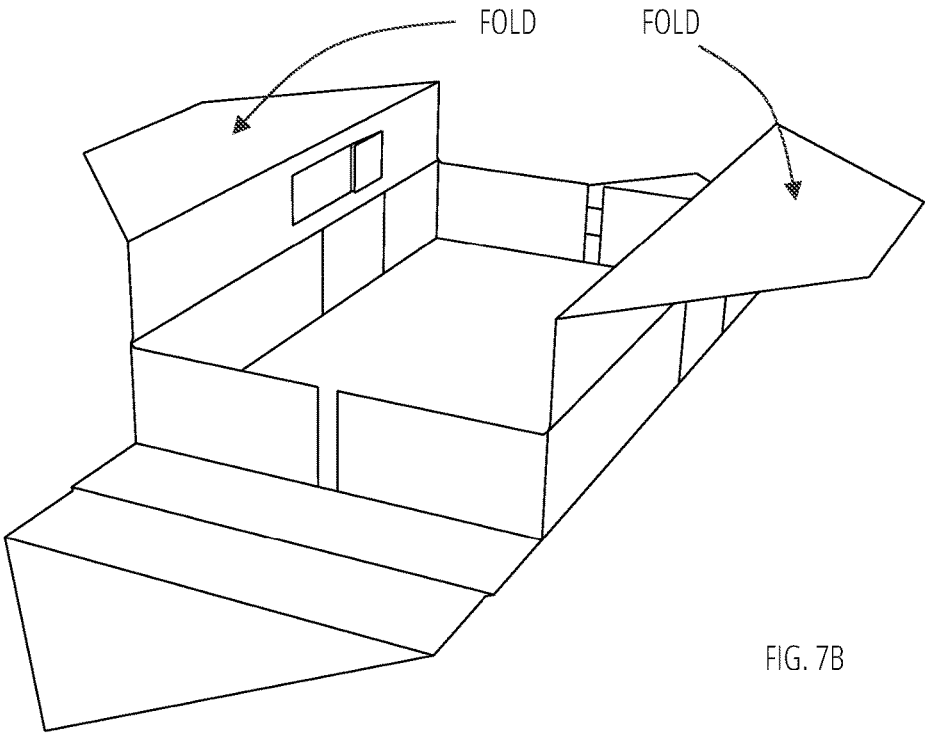

Cuts and scoring may form a tray spring assembly 502 as shown. Folding this portion of the flat along the tray spring folded edges 504 as shown in FIGS. 7A and 7B may form the tray folded tab spring 506. The illustrated embodiment shows a tray spring assembly 502 formed by a single fold of the folded tab. Alternate embodiments may be configured with multiple scores and folds forming the tray folded tab spring 506.

A tray locking tab 508 is also formed in the flat. When folded along the tray locking tab folded edge 510, this tab forms a flap that will engage with the sleeve retaining flap 102 in order to lock a fully inserted tray within the sleeve.

In an embodiment, at least a portion of the assembled container tray flat 500 may include an optional lid covering a portion of the assembled container tray flat 500.

Figure 6A:
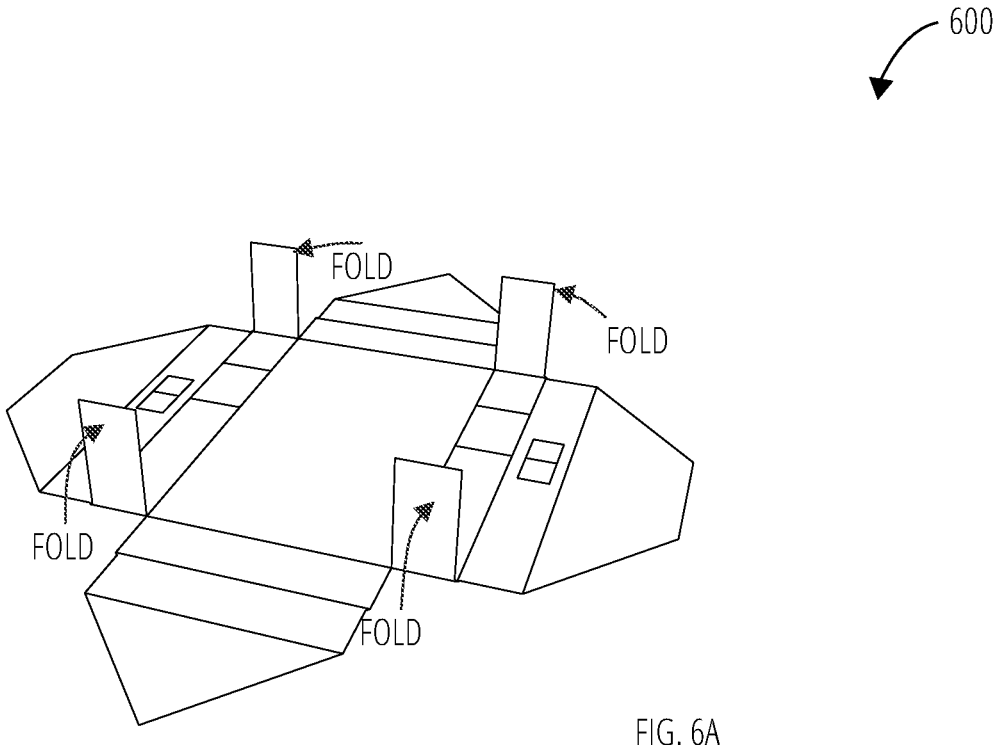
FIGS. 6A and 6B illustrate a container tray fold assembly 600 in accordance with one embodiment.
Figure 6B:
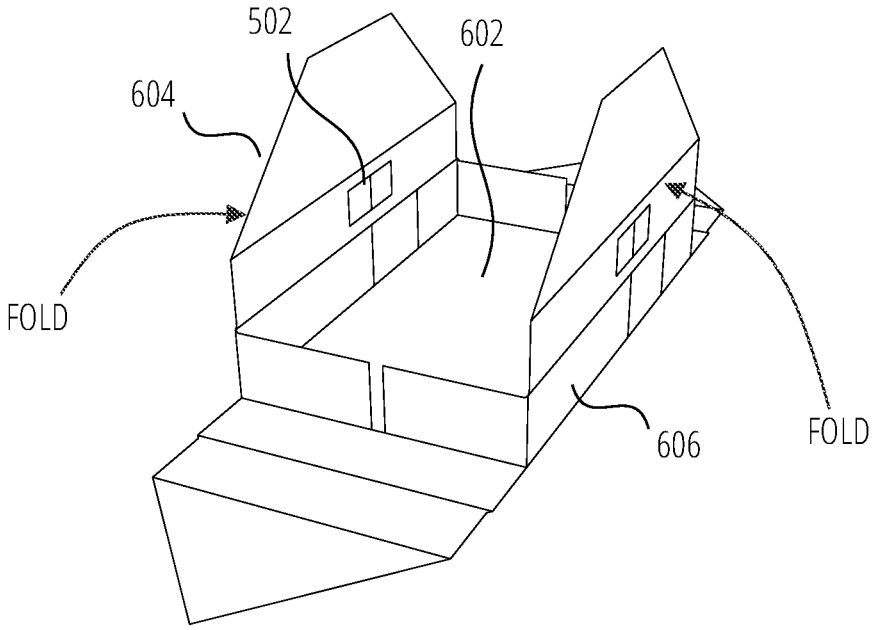

FIGS. 6A and 6B illustrate initial steps in the container tray fold assembly 600 in accordance with one embodiment. In this configuration, the four tabs provided to bring a stable tray assembly may be folded up to form right angles with the rest of the flat.

The portions of the flat that will form the tray second side member 604 and tray first side member 606, along with the adjoining portions that contain the tray spring assembly 502 may next be folded up to form right angles with the tray bottom member 602.

FIGS. 7A and 7B illustrate next steps in the container tray fold assembly 700 in accordance with one embodiment. The tray spring assembly 502 may be formed by folding the tray folded tab spring 506 along the tray spring folded edges 504 as shown. The entire cut portion of the tray folded tab spring 506 is first folded inward, against the flap it is cut out from. The end portion is folded inward again at least once, against the portion of the tray folded tab spring 506 that remains attached to the flat. In other embodiments, multiple folds may be used to form the tray folded tab spring 506.

Once the tray spring assembly 502 has been folded into place, the two panels with angled edges that adjoin the tray spring assembly flaps may be folded outward to form a right angle to the tray spring assembly flaps, as shown.

Figure 8A:
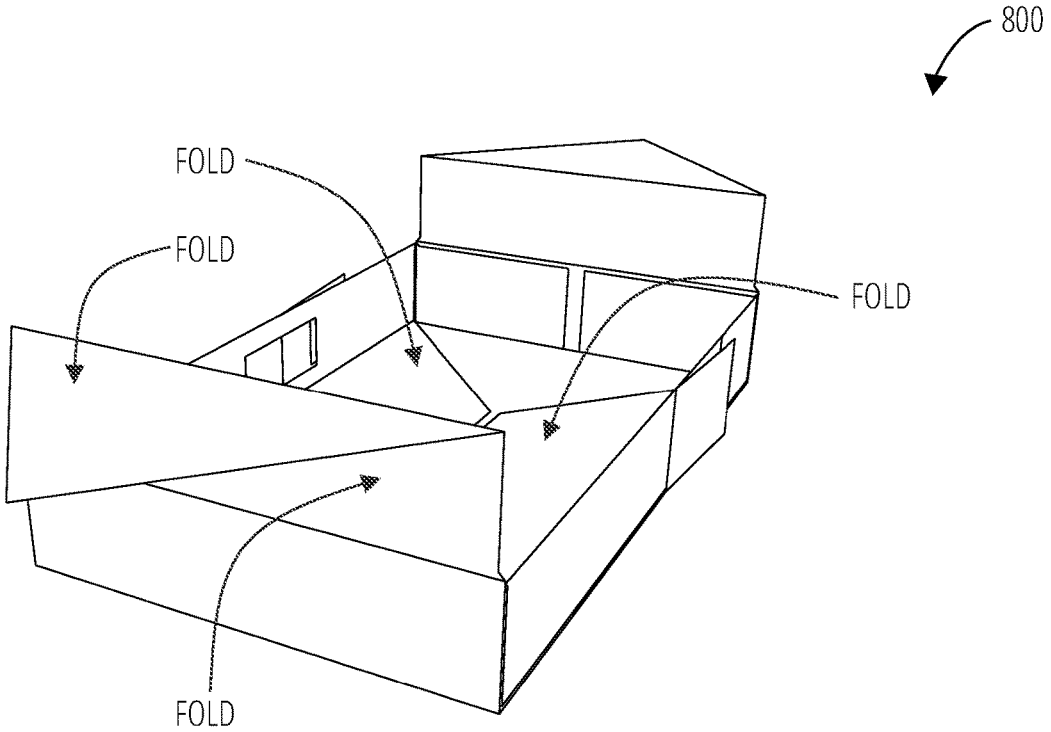
FIGS. 8A and 8B illustrate a container tray fold assembly 800 in accordance with one embodiment.
Figure 8B:
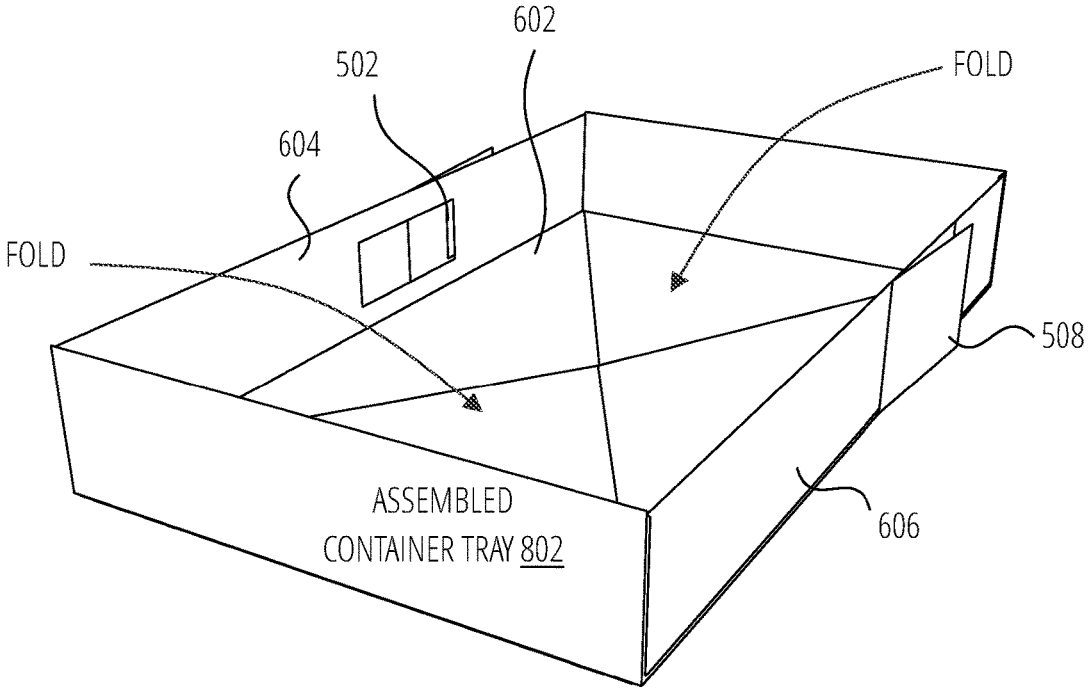

FIGS. 8A and 8B illustrate the final steps in the container tray fold assembly 800 in accordance with one embodiment. The panels with angled edges that adjoin the tray spring assembly 502 flaps may be folded down against the tray bottom member 602. These may be affixed with adhesive or some other means to the tray bottom member 602. Note that after this operation, the tray spring assembly 502 now faces outward, rather than inward over the tray bottom member 602. In this manner, the tray spring assembly 502 exerts an outward force on the tray locking tab 508.

The flaps that form both of the shorter ends of the tray may be first folded up to form a right angle with the tray bottom member 602. The triangular flaps in this embodiment may be folded outward at a right angle as shown. (In alternate embodiments, these flaps may be rectangular, rounded, or some other shape.) Finally, the triangular flaps may be folded down against the tray bottom member 602. These flaps may be fixed with adhesive or otherwise attached to the tray bottom member 602. In this manner, the container tray 802 may be assembled from the container tray flat 500.

In an embodiment, the assembled container tray 802 may include an optional lid that covers at least a portion of the assembled container tray 802. It there is an optional lid, then the lid may include a tray locking tab, and the sleeve may include a sleeve retaining flap and a sleeve lock release tab on a sleeve top member.

Figure 9A:
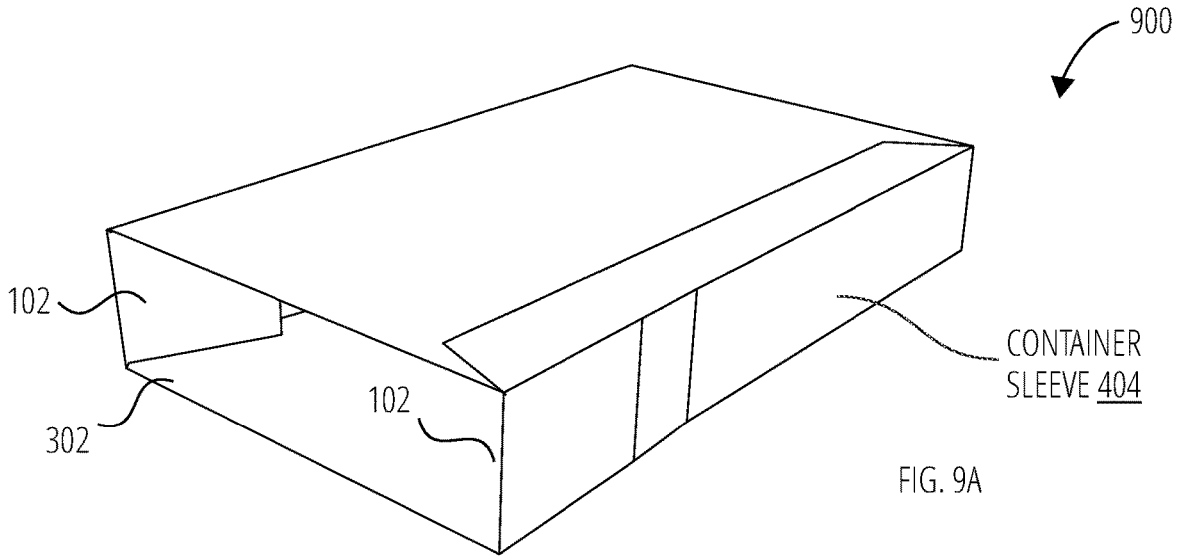
FIGS. 9A, 9B, and 9C illustrate a locking tab engagement 900 in accordance with one embodiment.
Figure 9B:
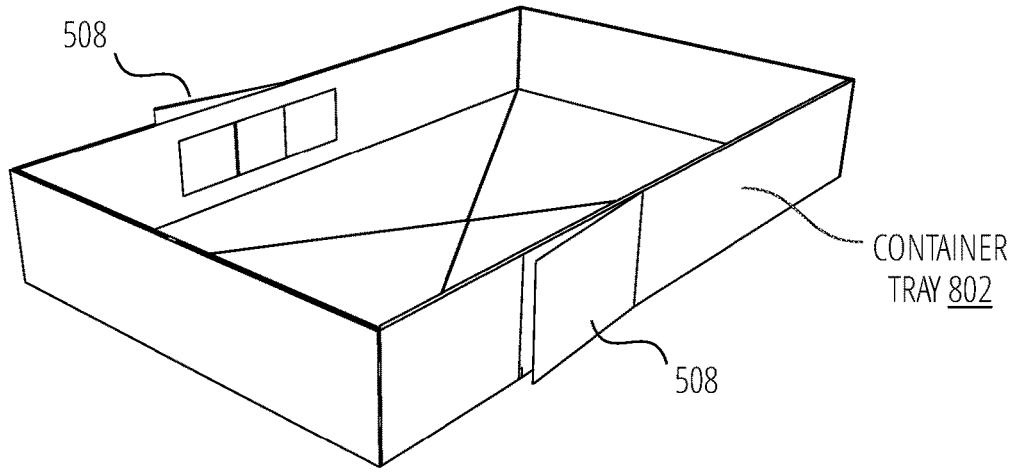
Figure 9C:
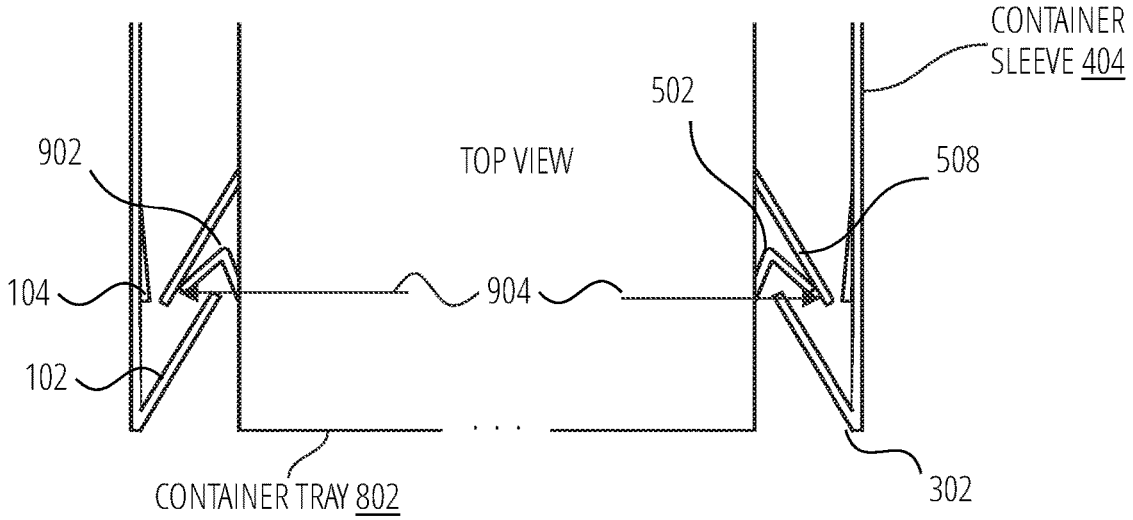

FIGS. 9A, 9B, and 9C illustrate locking tab engagement 900 in accordance with one embodiment. Once fully assembled, a container sleeve 404 may have a sleeve retaining flap 102 to each side of the aperture 302 as shown. Each sleeve retaining flap 102 will angle such that a gap exists between the end away from the aperture 302 and the sleeve walls forming the first and second side members of the sleeve. A fully assembled container tray 802 may have a tray locking tab 508 on each side. Each tray locking tab 508 may angle outward as shown due to pressure exerted by the tray spring assembly 502.

This can be seen in more detail in the top view shown. Because of the location and deflecting force 904 of the tray spring assembly 502 on each side of the container tray 802 when the spring is in an uncompressed state 902, the tray locking tab 508 may engage with and be obstructed by the sleeve retaining flap 102 to either side of the aperture 302. Should force be exerted to try to slide the container tray 802 out of the aperture 302 within the container sleeve 404 with these tabs engaged, the container tray 802 will be prevented from exiting the container sleeve 404.

In an embodiment, the sleeve retaining flap 102 can be glued to the sidewall of the container sleeve 404, or can be at an angle that allows tab 508 to clear when the sleeve lock release tab 104 has been compressed. The angle may be determined by the clearance between the container tray 802 and the container sleeve 404. In an embodiment, if the sleeve retaining flap 102 is not glued to the sidewall of the container sleeve 404, after a few attempts at removing the container tray 802, the sleeve retaining flap 102 may just come out with the container tray 802.

In another embodiment, the clearance between the inserted container tray 802 and the container sleeve 404 is small (i.e., a precise fit). This precise fit may allow the tray spring assembly 502 and tray locking tab 508 to remain tight to the sidewall of the container sleeve 404 and able to catch on the sleeve retaining flap 102 that has been glued in place.

Figure 10A:
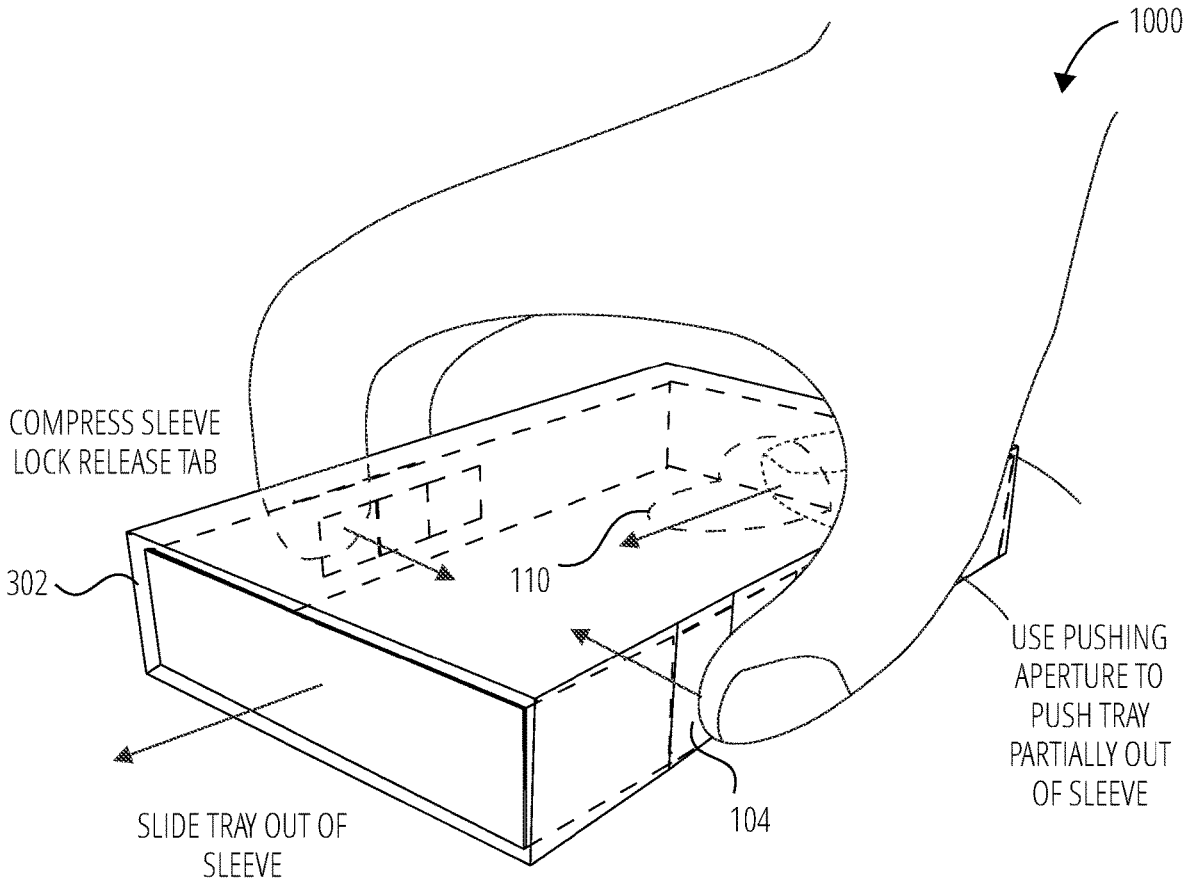
FIGS. 10A and 10B illustrate a locking tab disengagement 1000 in accordance with one embodiment.
Figure 10B:
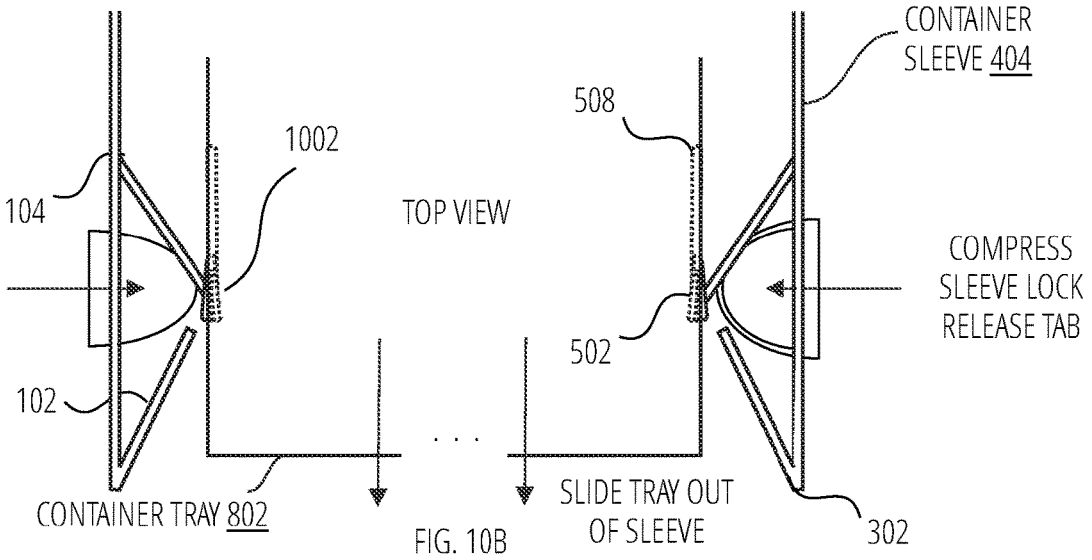

FIGS. 10A and 10B illustrate locking tab disengagement 1000 in accordance with one embodiment. When a container tray 802 is fully inserted into a container sleeve 404, the locking mechanisms will engage as shown in FIG. 9. In order to disengage the locking mechanism, a user may apply compress the sleeve lock release tab 104 on both sides of the sleeve. The user may apply a sliding force to the tray by means of the step pushing aperture 110 provided in the sleeve opposite from the aperture 302. This pushing force may cause the tray to slide out of the sleeve while the locking mechanism is disengaged.

This can be seen in more detail in the top view provided. When pressure is applied to the sleeve lock release tab 104 on both sides of the container sleeve 404, the sleeve lock release tab 104 places the tray spring assembly 502 in a compressed state 1002. The compression of the tray spring assembly 502 allows the tray locking tab 508 to return to an angle effectively parallel to the sides of the container tray 802. The tray locking tab 508 to each side will no longer engage the corresponding sleeve retaining flap 102. As a sliding force is applied to the tray by means of the pushing aperture, the tray is now free to slide out of the sleeve.

In some embodiments, the tray spring assembly may be configured such that a sleeve lock release tab is not needed.

The tray spring assembly may be adequately compressed in such embodiments when the portions of the sleeve sides immediately adjoining the tray locking tabs are pressed.

Figure 11:
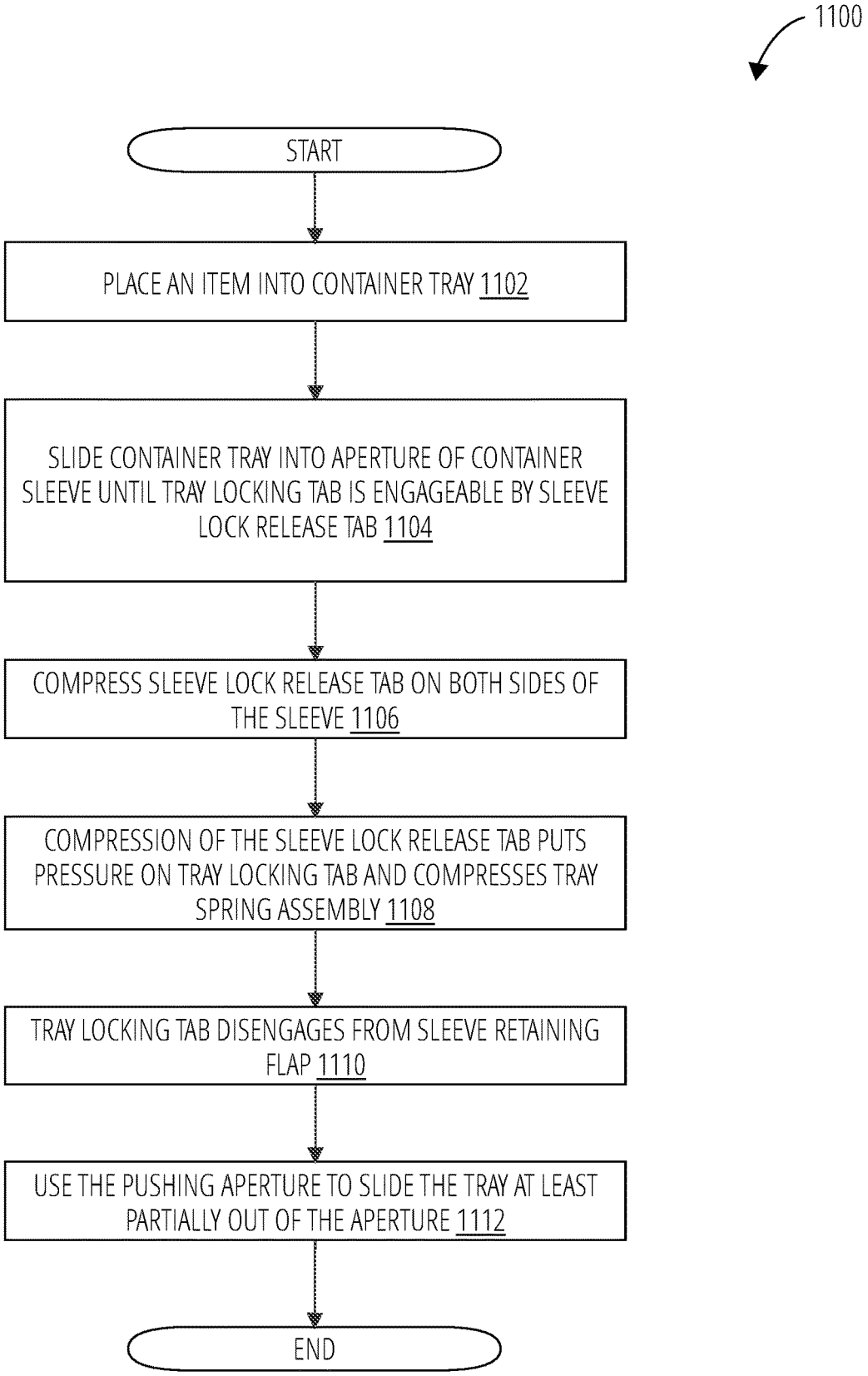
FIG. 11 illustrates a process 1100 in accordance with one embodiment.

FIG. 11 illustrates a process 1100 for using the container in accordance with one embodiment. In step 1102 of the process 1100, the user may place an item into the container tray. In step 1104, the user may slide the tray into an aperture of a container sleeve. The user may push the tray into the sleeve until the tray locking tab is engaged by the sleeve lock release tab. In this manner, the user may secure an item within the container.

In order to retrieve the item, the user may, in step 1106, press the sleeve lock release tab on both sides of the sleeve. In step 1108 the pressure created by pressing on the sleeve lock release tab may compress the tray locking tab, which in turn compresses the tray spring assembly. As a result, in step block 1110, the tray locking tab disengages from the sleeve retaining flap when the sleeve lock release tabs are pressed.

Finally, in step 1112, the user may apply a pushing force through the pushing aperture. This may cause the tray to slide at least partially out of the aperture.

The apparatuses and methods in this disclosure are described in the preceding on the basis of several preferred embodiments. Different aspects of different variants are considered to be described in combination with each other such that all combinations that upon reading by a skilled person in the field on the basis of this document may be regarded as being read within the concept of the disclosure. The preferred embodiments do not limit the extent of protection of this document.

Having thus described embodiments of the present disclosure of the present application in detail and by reference to illustrative embodiments thereof, it will be apparent that modifications and variations are possible without departing from the scope of the present disclosure.

What is claimed is:

1. A container comprising:

a sleeve including:

a sleeve top member;

a sleeve bottom member in a spaced apart and substantially parallel arrangement with the sleeve top member;

a sleeve first side member adjoining the sleeve top member and the sleeve bottom member;

a sleeve second side member opposite the sleeve first side member and adjoining the sleeve top member and the sleeve bottom member, thereby forming an aperture in a first sleeve end and a second sleeve end;

at least one sleeve retaining flap, wherein at least one of the sleeve first side member, the sleeve second side member, the sleeve bottom member, and the sleeve top member includes the at least one sleeve retaining flap; and at least one sleeve lock release tab, wherein at least one of the sleeve first side member, the sleeve second side member, and the sleeve bottom member includes the at least one sleeve lock release tab; and a tray slidable into the aperture of the sleeve, the tray including:

a tray bottom member;

a tray first side member adjoined to and substantially perpendicular to the tray bottom member;

a tray second side member adjoined to and substantially perpendicular to the tray bottom member and opposite the tray first side member, wherein the tray is slidable through the aperture in at least one of the first sleeve end and the second sleeve end;

at least one tray spring assembly;

at least one tray locking tab configured to be engaged by the at least one sleeve lock release tab, wherein at least one of the tray first side member, the tray second side member, and the tray bottom member includes the at least one tray spring assembly; and the at least one tray locking tab configured to:

engage the at least one sleeve retaining flap on condition the at least one tray spring assembly is in an uncompressed state and the tray is forced in a direction to slide the tray out of the aperture, thereby retaining the tray in the sleeve; and not engage the at least one sleeve retaining flap on condition the at least one tray spring assembly is in a compressed state and the tray is forced in a direction to slide the tray out of the aperture, thereby allowing the tray to slide out of the sleeve;

wherein the first sleeve end and the second sleeve end each comprise the aperture, wherein the sleeve includes at least two sleeve retaining flaps and the tray includes at least two tray locking tabs, and wherein one of the at least two sleeve retaining flaps and one of the at least two tray locking tabs are configured to prevent the tray from sliding out of the first sleeve end and another of the at least two sleeve retaining flaps and another of the at least two tray locking tabs are configured to prevent the tray from sliding out of the second sleeve end.

2. The container of claim 1, wherein the at least one tray spring assembly includes a folded tab configured to provide a deflecting force against the at least one tray locking tab.

3. The container of claim 1, the sleeve further comprising an end member at the first sleeve end or the second sleeve end, the end member adjoining the sleeve top member and the sleeve bottom member.

4. The container of claim 3, the end member further comprising a pushing aperture, the pushing aperture configured as an opening in the end member that is otherwise closed.

5. The container of claim 1, wherein the tray further comprises a tray top member in a spaced apart, substantially parallel arrangement with the tray bottom member and wherein the tray top member may be opened and closed.

6. The container of claim 5, wherein the at least one tray locking tab is included in at least one of the tray first side member, the tray second side member, the tray bottom member, and the tray top member.

7. The container of claim 5, wherein the sleeve top member includes a pushing aperture, the pushing aperture configured as an opening in the sleeve top member.

8. The container of claim 1, wherein the at least one tray spring assembly is configured to be in the compressed state when an immediately adjoining portion of the sleeve is pressed.

9. The container of claim 1, wherein at least one of the sleeve first side member, the sleeve second side member, and the sleeve bottom member further comprises a pushing aperture.

10. A container comprising:

a sleeve including:

a sleeve top member;

a sleeve bottom member in a spaced apart and substantially parallel arrangement with the sleeve top member;

a sleeve first side member adjoining the sleeve top member and the sleeve bottom member;

a sleeve second side member opposite the sleeve first side member and adjoining the sleeve top member and the sleeve bottom member, thereby forming an aperture in a first sleeve end and a second sleeve end;

at least one sleeve retaining flap, wherein the sleeve top member includes the at least one sleeve retaining flap; and at least one sleeve lock release tab, wherein the sleeve top member includes the at least one sleeve lock release tab; and a tray slidable into the aperture of the sleeve, the tray including:

a tray bottom member;

a tray top member in a spaced apart, substantially parallel arrangement with the tray bottom member, wherein the tray top member may be opened and closed;

a tray first side member adjoined to and substantially perpendicular to the tray bottom member;

a tray second side member adjoined to and substantially perpendicular to the tray bottom member and opposite the tray first side member, wherein the tray is slidable through the aperture in at least one of the first sleeve end and the second sleeve end;

at least one tray spring assembly;

at least one tray locking tab configured to be engaged by the at least one sleeve lock release tab, wherein the tray top member includes the at least one tray spring assembly and the at least one tray locking tab; and the at least one tray locking tab configured to:

engage the at least one sleeve retaining flap on condition the at least one tray spring assembly is in an uncompressed state and the tray is forced in a direction to slide the tray out of the aperture, thereby retaining the tray in the sleeve; and not engage the at least one sleeve retaining flap on condition the at least one tray spring assembly is in a compressed state and the tray is forced in a direction to slide the tray out of the aperture, thereby allowing the tray to slide out of the sleeve.

11. The container of claim 10, wherein the first sleeve end and the second sleeve end each comprise the aperture, wherein the sleeve includes at least two sleeve retaining flaps and the tray includes at least two tray locking tabs, and wherein one of the at least two sleeve retaining flaps and one of the at least two tray locking tabs are configured to prevent the tray from sliding out of the first sleeve end and another of the at least two sleeve retaining flaps and another of the at least two tray locking tabs are configured to prevent the tray from sliding out of the second sleeve end.

12. A method of securing an item in a container, the method comprising:

placing the item into a tray of the container, wherein the tray is slidable into a sleeve of the container, and the container comprises:

the sleeve including:

a sleeve top member;

a sleeve bottom member in a spaced apart and substantially parallel arrangement with the sleeve top member;

a sleeve first side member adjoining the sleeve top member and the sleeve bottom member;

a sleeve second side member opposite the sleeve first side member and adjoining the sleeve top member and the sleeve bottom member, thereby forming an aperture in a first sleeve end and a second sleeve end;

at least one sleeve retaining flap, wherein at least one of the sleeve first side member, the sleeve second side member, the sleeve bottom member, and the sleeve top member includes the at least one sleeve retaining flap; and at least one sleeve lock release tab, wherein at least one of the sleeve first side member, the sleeve second side member, and the sleeve bottom member includes the at least one sleeve lock release tab; and the tray including:

a tray bottom member;

a tray first side member adjoined to and substantially perpendicular to the tray bottom member;

a tray second side member adjoined to and substantially perpendicular to the tray bottom member and opposite the tray first side member, wherein the tray is slidable through the aperture in at least one of the first sleeve end and the second sleeve end;

at least one tray spring assembly;

at least one tray locking tab configured to be engaged by the at least one sleeve lock release tab, wherein at least one of the tray first side member, the tray second side member, and the tray bottom member includes the at least one tray spring assembly; and the at least one tray locking tab configured to:

engage the at least one sleeve retaining flap on condition the at least one tray spring assembly is in an uncompressed state and the tray is forced in a direction to slide the tray out of the aperture, thereby retaining the tray in the sleeve; and not engage the at least one sleeve retaining flap on condition the at least one tray spring assembly is in a compressed state and the tray is forced in a direction to slide the tray out of the aperture, thereby allowing the tray to slide out of the sleeve;

wherein the first sleeve end and the second sleeve end each comprise the aperture, wherein the sleeve includes at least two sleeve retaining flaps and the tray includes at least two tray locking tabs, and wherein one of the at least two sleeve retaining flaps and one of the at least two tray locking tabs are configured to prevent the tray from sliding out of the first sleeve end and another of the at least two sleeve retaining flaps and another of the at least two tray locking tabs are configured to prevent the tray from sliding out of the second sleeve end; and sliding the tray into the aperture of the sleeve until the at least one tray locking tab is in a position that is engageable by the at least one sleeve lock release tab.

13. The method of claim 12, further comprising:

compressing the at least one tray spring assembly; and sliding the tray at least partially out of the aperture.

14. The method of claim 13, wherein compressing the at least one tray spring assembly includes pressing the at least one sleeve lock release tab, wherein the at least one sleeve lock release tab engages the at least one tray locking tab.

15. The method of claim 12, wherein the at least one tray spring assembly includes a folded tab configured to provide a deflecting force against the at least one tray locking tab.

16. The method of claim 12, wherein the sleeve further comprises an end member at the first sleeve end or the second sleeve end, the end member adjoining the sleeve top member and the sleeve bottom member.

17. The method of claim 16, the end member further comprising a pushing aperture, the pushing aperture configured as an opening in the end member that is otherwise closed.

18. The method of claim 12, wherein the tray further comprises a tray top member in a spaced apart, substantially parallel arrangement with the tray bottom member and wherein the tray top member may be opened and closed.

19. The method of claim 18, wherein the at last one tray locking tab is included in at least one of the tray first side member, the tray second side member, the tray bottom member, and the tray top member.

20. The method of claim 18, wherein the sleeve top member includes a pushing aperture, the pushing aperture configured as an opening in the sleeve top member.

* * * * *